US008553916B2

(12) United States Patent
Steinbuss

(10) Patent No.: US 8,553,916 B2
(45) Date of Patent: Oct. 8, 2013

(54) METHOD AND HEARING AID FOR CHANGING THE SEQUENCE OF PROGRAM POSITIONS

(75) Inventor: Andre Steinbuss, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 527 days.

(21) Appl. No.: 12/424,854

(22) Filed: Apr. 16, 2009

(65) Prior Publication Data

US 2009/0262965 A1 Oct. 22, 2009

(30) Foreign Application Priority Data

Apr. 16, 2008 (DE) ..... 10 2008 019 105

(51) Int. Cl.
*H04R 25/00* (2006.01)

(52) U.S. Cl.
USPC ..... 381/314; 381/23.1; 381/56; 381/57; 381/58; 381/59; 381/60; 381/312; 381/313; 381/323; 381/328

(58) Field of Classification Search
USPC ..... 381/23.1, 312–315, 56–60, 323, 328
See application file for complete search history.

(56) References Cited

U.S. PATENT DOCUMENTS 3,901,215 A * 8/1975 John ..... 600/544
4,425,481 A * 1/1984 Mansgold et al. ..... 381/317
4,972,487 A * 11/1990 Mangold et al. ..... 381/315
5,144,674 A * 9/1992 Meyer et al. ..... 381/314
5,303,306 A * 4/1994 Brillhart et al. ..... 381/315
5,910,997 A * 6/1999 Ishige et al. ..... 381/314
6,104,822 A * 8/2000 Melanson et al. ..... 381/320
7,236,603 B2 * 6/2007 Mergell ..... 381/312
7,242,777 B2 * 7/2007 Leenen et al. ..... 381/60
7,428,312 B2 * 9/2008 Meier et al. ..... 381/312
7,529,545 B2 * 5/2009 Rader et al. ..... 455/432.2
7,688,990 B2 * 3/2010 Hellgren et al. ..... 381/312
7,876,914 B2 * 1/2011 Grosvenor et al. ..... 381/92
7,903,825 B1 * 3/2011 Melanson ..... 381/57
7,974,716 B2 * 7/2011 Schumaier ..... 700/94
2002/0044669 A1 * 4/2002 Meyer et al. ..... 381/314
2004/0066944 A1 * 4/2004 Leenen et al. ..... 381/314
2004/0131195 A1 * 7/2004 Mergell ..... 381/60
2004/0156516 A1 * 8/2004 Mortensen ..... 381/312
2005/0111680 A1 * 5/2005 Meier et al. ..... 381/314
2005/0129262 A1 * 6/2005 Dillon et al. ..... 381/312
2005/0281410 A1 * 12/2005 Grosvenor et al. ..... 381/61
2006/0078139 A1 * 4/2006 Meier et al. ..... 381/312

(Continued)

FOREIGN PATENT DOCUMENTS

DE 102004025691 B3 8/2005
DE 603 07 576 T2 10/2007
EP 1420611 A1 5/2004

*Primary Examiner* — Fernando L Toledo
*Assistant Examiner* — Mohammed Shamsuzzaman

(57) ABSTRACT

A method, hearing aid, and computer product for changing the sequence of program positions of hearing programs are provided. The program positions of the hearing programs have a predefinable sequence. Time periods, within which hearing programs are selected, are measured. A new sequence of the program positions is calculated taking the measured time periods into account. The sequence of the program positions after a predefinable time span is modified in accordance with the calculated sequence. As a result hearing aids adapt to changed environments and place favorite programs in the front section of the program positions in accordance with the hearing aid wearer's preference.

6 Claims, 2 Drawing Sheets

(56) References Cited

U.S. PATENT DOCUMENTS

| | | | | |
|---|---|---|---|---|
| 2006/0098831 | A1* | 5/2006 | Kaiser et al. | 381/312 |
| 2006/0222194 | A1* | 10/2006 | Bramslow et al. | 381/314 |
| 2007/0053535 | A1* | 3/2007 | Frieding | 381/312 |
| 2007/0067054 | A1* | 3/2007 | Danish | 700/94 |
| 2007/0276285 | A1* | 11/2007 | Burrows et al. | 600/559 |
| 2007/0291969 | A1* | 12/2007 | Tateno et al. | 381/315 |
| 2009/0248182 | A1* | 10/2009 | Logan et al. | 700/94 |
| 2010/0030089 | A1* | 2/2010 | Hyde et al. | 600/508 |
| 2010/0034405 | A1* | 2/2010 | Roeck et al. | 381/315 |
| 2010/0104123 | A1* | 4/2010 | Steinbuss | 381/317 |
| 2010/0158262 | A1* | 6/2010 | Schumaier et al. | 381/60 |
| 2010/0195839 | A1* | 8/2010 | Barthel et al. | 381/60 |
| 2010/0272297 | A1* | 10/2010 | Boretzki | 381/312 |
| 2011/0051964 | A1* | 3/2011 | Balke et al. | 381/321 |
| 2011/0129094 | A1* | 6/2011 | Petersen | 381/23.1 |

* cited by examiner

METHOD AND HEARING AID FOR CHANGING THE SEQUENCE OF PROGRAM POSITIONS

CROSS REFERENCE TO RELATED APPLICATIONS

This application claims priority of German application No. 10 2008 019 105.1 filed Apr. 16, 2008, which is incorporated by reference herein in its entirety

FIELD OF INVENTION

The invention relates to a method for setting a hearing aid and a hearing aid in which the hearing programs can be selected.

BACKGROUND OF INVENTION

Modern hearing aids generally possess complex classification algorithms enabling automatic adaptation to environmental situations so as to ensure satisfactory hearing comfort and good speech intelligibility at all times. A method in this regard for adapting a hearing aid to a current acoustic environmental situation is disclosed in patent publication DE 603 07 576 T2. One of a plurality of hearing programs in the hearing aid is therein offered to the hearing aid wearer, while at the same time the current acoustic environmental situation is analyzed. Learning hearing aids, as described in patent publication US 2005 0129262, are also known.

SUMMARY OF INVENTION

In spite of all the aforesaid improvements, hearing aid wearers often wish for changes in the configuration of a hearing aid, also in the sequence of the stored hearing programs for example. Investigations and observations made by the applicant demonstrate that about half of all hearing aid wearers would like a change in the program sequence. At the present time, however, the sequence of the program positions can only be changed by the hearing aid acoustician or the manufacturer. This is perceived as inconvenient on the part of the hearing aid wearers.

It is the object of the invention to overcome these disadvantages and to disclose a method and an associated hearing aid which more effectively adapt the sequence of the program positions to the needs of a hearing aid wearer.

According to the invention the object addressed is achieved by means of the method recited 1 and the hearing aid recited in the independent claims.

According to the invention the method for setting a hearing aid in which hearing programs can be selected, the program positions of the hearing programs having a predefinable sequence, comprises the following steps:

- Measuring time periods within which hearing programs are selected,
- calculating a new sequence of the program positions with the aid of a learning algorithm, taking the measured time periods into account, and
- modifying the sequence of the program positions after a predefinable time span in accordance with the calculated sequence. This offers the advantage that hearing aids adapt to new acoustic environments, and favorite programs are placed in the front section of the program positions in accordance with the hearing aid wearer's preference.

In a further embodiment variant the learning algorithm can weight the measured time periods, with the program position of a hearing program selected for a longer time being placed before the program position of a hearing program selected for a shorter time. As a result the usage time of a hearing program becomes a metric for the hearing aid wearer's preference.

In a development the learning algorithm can take into account at least one sound variable relating to an environmental situation and/or at least one desired setting value of the hearing aid. An advantageous aspect of this is the inclusion of additional characteristic variables.

Furthermore a selected hearing program can be signaled to a hearing aid wearer by means of a sound icon or a talking beep. Preferably the name identifying the selected hearing program can be displayed on a remote control of the hearing aid. By this means the hearing aid wearer quickly and easily recognizes the selected program.

In a further embodiment variant the hearing program in the first program position can be selected automatically when the hearing aid is switched on. This makes a hearing aid wearer's favorite program active immediately when the hearing aid is switched on.

Also disclosed according to the invention is a hearing aid in which hearing programs can be selected, the program positions of the hearing programs having a predefinable sequence. The hearing aid includes a measurement module by means of which it is possible to measure time periods within which hearing programs are selected, a computing module having a learning algorithm by means of which a new sequence of the program positions can be calculated taking the measured time periods into account, and a change module by means of which the sequence of the program positions can be modified after a predefinable time span in accordance with the calculated sequence.

In a further embodiment variant the computing module can weight the measured time periods in such a way that the program position of a hearing program selected for a longer time comes before the program position of a hearing program selected for a shorter time.

In a development each selected hearing program can be signaled to a user by means of a distinguishable sound icon or a different talking beep through a hearing aid receiver. By this means the program selection becomes clearly audible.

Advantageously, the name of the selected hearing program can be displayed on a display of a remote control.

Furthermore, the hearing program in the first program position, which can correspond to the favorite program of a hearing aid wearer, can be selected automatically when the hearing aid is switched on.

In a development the hearing aid can be preconfigured at the time of sale/dispatch in different hearing programs for different hearing losses. As a result the hearing aid does not have to be specially adjusted at the time of sale or, as the case may be, at the time of dispatch to the hearing capacity of the hearing aid wearer.

BRIEF DESCRIPTION OF THE DRAWINGS

Further special features and advantages of the invention will become apparent from the following explanations relating to an exemplary embodiment and with reference to schematic drawings, in which.

DETAILED DESCRIPTION OF INVENTION

Figure 1:
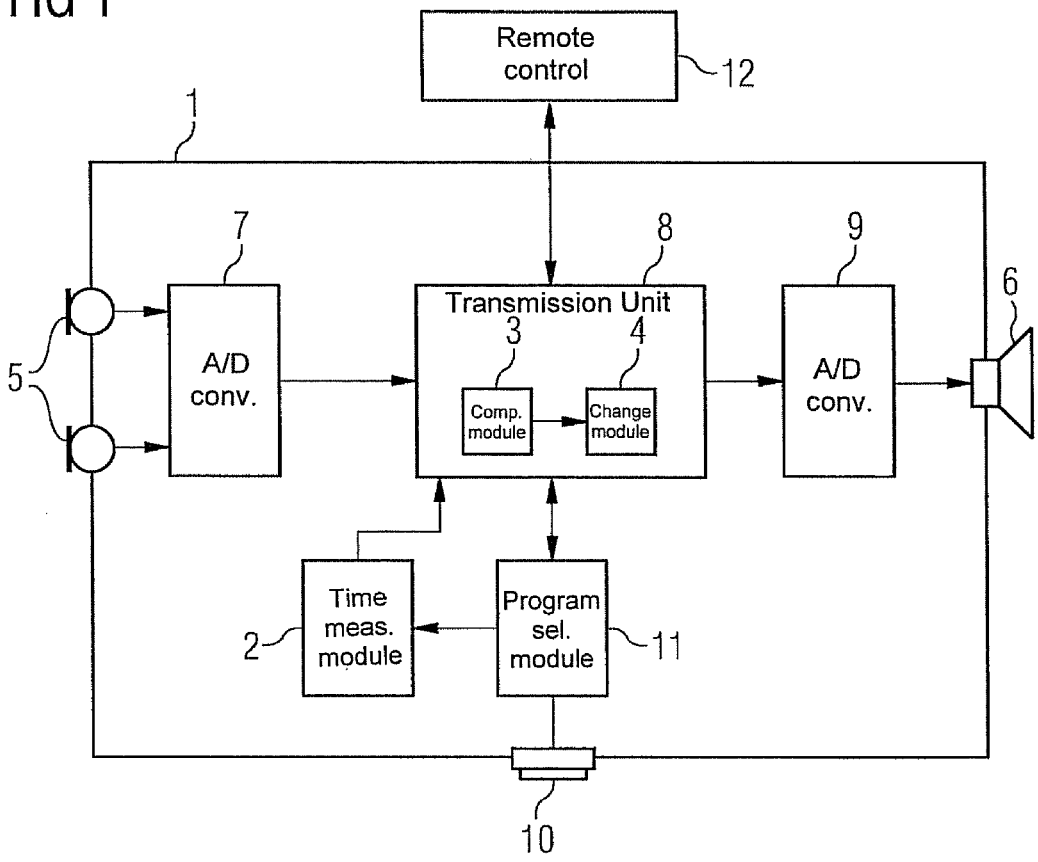
FIG. 1: shows a block diagram of a hearing aid with program selection.

FIG. 1 shows a functional block diagram of a hearing aid 1 according to the invention. The hearing aid 1 comprises an electroacoustic transducer, two microphones 5 for example, and a receiver 6 (speaker). The microphones 5 are connected via an analog/digital converter 7 to an input of a signal processing and transmission unit 8 whose transmission characteristic is adjustable. On its output side the signal processing and transmission unit 8 is connected via a digital/analog converter 9 to the receiver 6. A number of different signal processing parameter sets, each set belonging to a hearing program, can be selected in the signal processing and transmission unit 8.

A program selection button 10 for selecting hearing programs is connected to an input and output of the signal processing and transmission unit 8 and to an input of a time measurement module 2 via a program selection module 11 in which, inter alia, the sequence of the program positions is stored. An output of the time measurement module 2 is connected to an input of the signal processing and transmission unit 8. A remote control 12 is connected to an input/output of the signal processing and transmission unit 8 via a wireless interface.

When the hearing aid 1 is shipped or after it has been set by a hearing aid acoustician, the program positions of the hearing programs have a sequence corresponding to the expected usage behavior of a hearing aid wearer. In this case the most preferred hearing program is in the first position and the program that is expected to be least useful is placed last. However, the real needs of the hearing aid wearer are usually different from these preset default settings. Only when the hearing aid is in operation does the user realize that other hearing programs are more important and therefore need to be placed in a position further forward in the sequence so as to be more easily and quickly selectable.

The time measurement module 2 therefore measures the time periods within which individual hearing programs are selected. From these time periods a computing module 3 in the signal processing and transmission unit 8 calculates a new sequence of the program positions with the aid of a learning algorithm. After a definable time span this new sequence is transmitted to a change module 4 which thereupon modifies the sequence of the program positions in the program selection module 11 accordingly. The new sequence is then made available to the hearing aid user. The different programs are recognizable by means of distinguishable sound icons or talking beeps in the receiver.

Over a defined time span the hearing aid 1 therefore automatically learns which is the preferred hearing program of its hearing aid wearer from the measured individual usage time. For example, the first program position is occupied by the most frequently used hearing program, the second program position by the second most frequent, etc.

Figure 2:
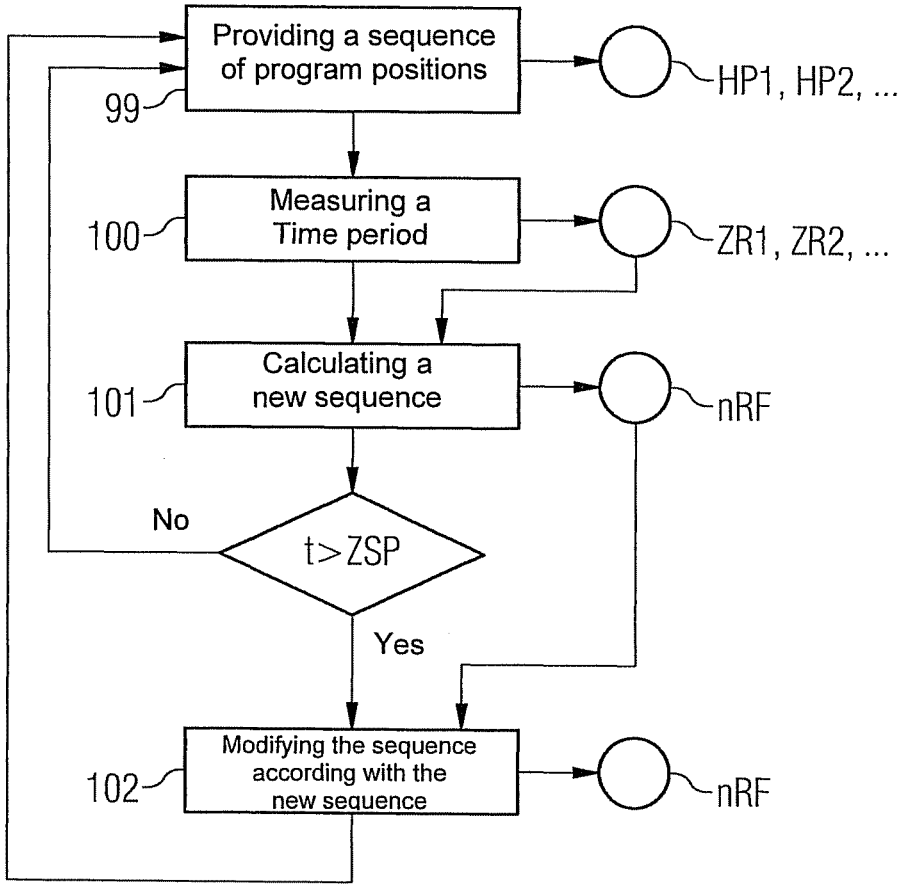
FIG. 2: is a flowchart of a method for setting a hearing aid.

FIG. 2 presents a method according to the invention in the form of a flowchart. The method for setting a hearing aid in which hearing programs HP1, HP2, . . . can be selected, wherein the program positions of the hearing programs HP1, HP2, . . . have a predefinable sequence, starts with the selection 99 of a hearing program HP1. At step 100, a time period ZR1 within which the hearing program HP1 remains selected is measured. At the following step 101, a new sequence nRF of the program positions is calculated with the aid of a learning algorithm, taking the measured time period ZR1 into account. At step 102, if a predefinable time span ZSP has expired, the sequence of the program positions is modified in accordance with the calculated sequence nRF. If the time span ZSP has not yet expired or if a different hearing program HP2 is selected in accordance with step 99, a continued measurement or new measurement of a time period takes place.

As a result a hearing aid user's favorite hearing programs are placed in the front section of the program positions. In addition the hearing aid can start already in the favorite program of a user, since hearing aids typically start in the first program.

The invention claimed is:

1. A method for setting a hearing aid with a sequence of program positions, each program position corresponding to a hearing program, the method comprising:

measuring, by a time measurement module for each hearing program that is selected by a selection device, a time period in which the hearing program is selected;

calculating, via a learning algorithm by a computing module, a new sequence of the program positions using the measured time periods, the calculating the new sequence takes into account a desired setting value of the hearing aid;

modifying the sequence of the program positions by a change module after a predefinable time span in accordance with the calculated new sequence wherein the new sequence is such that the program position of the hearing program selected for a longer time comes before the program position of the hearing program selected for a shorter time and wherein each hearing program is available for use after the new sequence is calculated, whereby the hearing aid is set with the sequence of program positions that was calculated using the measured time periods;

determining that the measured time periods are less than the predefinable time span or that a different hearing program is selected, wherein a continued measurement or a new measurement of time period takes place in response to the determining that the measured time periods are less than the predefinable time span or that the different hearing program is selected.

2. The method as claimed in claim 1, wherein the calculating the new sequence includes weighting the measured time periods.

3. The method as claimed in claim 1, wherein the hearing program that is selected is signaled to a hearing aid wearer via a sound icon or a talking beep.

4. The method as claimed in claim 1, wherein a name identifying the hearing program that is selected is displayed on a remote control of the hearing aid.

5. The method as claimed in claim 1, wherein the hearing program occupying a first program position is selected automatically when the hearing aid is switched on.

6. The method as claimed in claim 1, wherein a non-transitory computer readable medium with computer executable instructions performs the method when executed on a control unit of the hearing aid.

* * * * *